US006570371B1

(12) United States Patent
Volk

(10) Patent No.: US 6,570,371 B1
(45) Date of Patent: May 27, 2003

(54) APPARATUS AND METHOD OF MIRRORING A VOLTAGE TO A DIFFERENT REFERENCE VOLTAGE POINT

(75) Inventor: Andrew M. Volk, Granite Bay, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/038,022

(22) Filed: Jan. 2, 2002

(51) Int. Cl.[7] ..... G05F 3/16; G05F 3/20
(52) U.S. Cl. ..... 323/315; 323/316
(58) Field of Search ..... 323/313, 314, 323/315, 316

(56) References Cited

U.S. PATENT DOCUMENTS

| | | | | | |
|---|---|---|---|---|---|
| 4,251,743 | A | * | 2/1981 | Hareyama | 327/538 |
| 4,864,216 | A | * | 9/1989 | Kalata et al. | 323/315 |
| 5,319,303 | A | * | 6/1994 | Yamada | 323/313 |
| 5,917,311 | A | * | 6/1999 | Brokaw | 323/280 |
| 6,271,716 | B1 | * | 8/2001 | Nayebi et al. | 327/538 |
| 6,275,090 | B1 | * | 8/2001 | Burger et al. | 327/334 |
| 6,343,024 | B1 | * | 1/2002 | Zabroda | 363/22 |
| 6,359,427 | B1 | * | 3/2002 | Edwards et al. | 323/316 |
| 6,424,131 | B1 | * | 7/2002 | Yamamoto et al. | 323/282 |

OTHER PUBLICATIONS

Wu, Tien–Yu Et Al., "A low glitch 10–bit 75–MHz CMOS Video D/A Converter," IEEE JSSC, vol. 30, No. 1, Jan. 1995, pp 68–72.

S. Chin, C. Wu, "A 10–b 125–MHz CMOS Digital–to–analog converter (DAC) with threshold voltage compensated current sources," IEEE JSSC, vol. 29, No. 11, Nov. 1994, pp 1374–1380.

* cited by examiner

*Primary Examiner*—Bao Q. Vu
(74) *Attorney, Agent, or Firm*—Blakley, Sokoloff, Taylor & Zafman LLP

(57) ABSTRACT

A voltage mirroring circuit to output a voltage that is derived from a reference voltage. A reference voltage is applied to the positive input of an operational amplifier, which is used as a unity gain amplifier to generate a feedback voltage. The feedback voltage is applied across a resistor to form a current. The current is directed through a load resistor to form the output voltage. The output voltage is a function of the resistance ratio of the load resistor to the current-setting resistor. Also, a multiple-output voltage mirroring circuit in which the current formed by the use of the operational amplifier and the current-settings resistor is mirrored to generate a plurality of currents. These currents are directed through respective load resistors to form output voltages. The output voltages are a function of the resistance ratios of the respective load resistors to the current-setting resistor.

26 Claims, 4 Drawing Sheets

APPARATUS AND METHOD OF MIRRORING A VOLTAGE TO A DIFFERENT REFERENCE VOLTAGE POINT

FIELD OF THE INVENTION

This invention relates generally to voltage mirroring circuits, and in particular, to an apparatus and method of mirroring a voltage to one or more different reference voltage points.

BACKGROUND OF THE INVENTION

Many integrated circuits incorporate a voltage reference circuit, such as a bandgap circuit, to generate a highly stable reference voltage. The reference voltage is typically used by one or more circuits and/or devices to perform their intended functions. The highly stable reference voltage facilitates these circuits and/or devices to perform their intended function within specification even with temperature, supply voltage, and/or process variations.

When an integrated circuit needs a plurality of different highly stable reference voltages, a plurality of reference voltage circuits, such as bandgap circuits, can be provided to generate the required reference voltages. However, incorporating a plurality of reference voltage circuits into an integrated circuit would unduly consume integrated circuit space, power, and increase the cost and complexity of the integrated circuit.

DETAILED DESCRIPTION OF THE INVENTION

Figure 1:
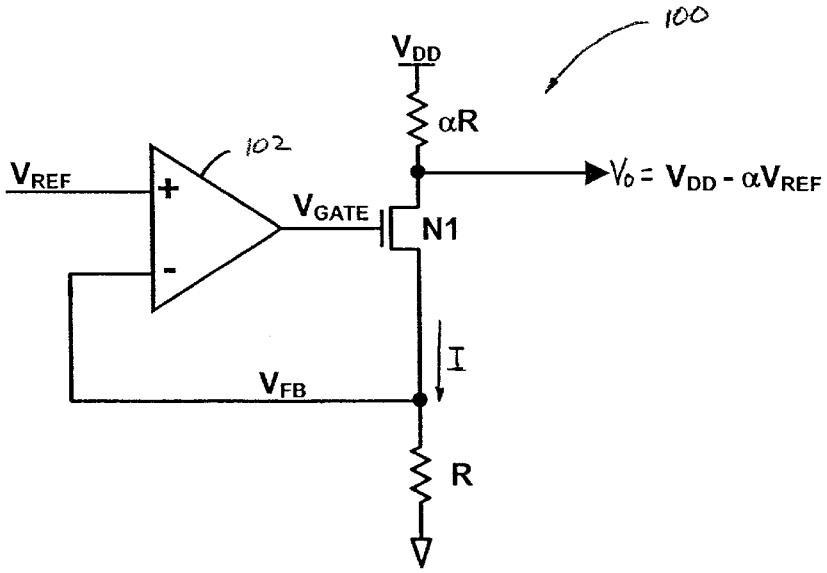
FIG. 1 illustrates a schematic diagram of an exemplary voltage mirroring circuit in accordance with an embodiment of the invention.

FIG. 1 illustrates a schematic diagram of an exemplary voltage mirroring circuit 100 in accordance with an embodiment of the invention. The voltage mirroring circuit 100 comprises an operational amplifier 102, an n-channel field effect transistor (FET) N1, a current-setting resistor R, and a load resistor αR. The operational amplifier 102 includes a positive input to receive a reference voltage $V_{REF}$, a negative input coupled to the source of the FET N1 and an end of the current-setting resistor R, and an output coupled to the gate of the FET N1. The other end of the current-setting resistor R can be coupled to ground potential. The load resistor αR is coupled between the power supply voltage rail $V_{DD}$ and the drain of the FET N1.

In operation, the operational amplifier 102 sets the gate voltage $V_{GATE}$ of the FET N1 such that the feedback voltage $V_{FB}$ applied to the negative input of the operational amplifier 102 is substantially equal to the reference voltage $V_{REF}$ applied to the positive input of the operational amplifier 102 (i.e. mirroring the reference voltage $V_{REF}$ onto the feedback voltage $V_{FB}$). Thus, the following relationship substantially holds:

$$V_{FB}=V_{REF} \quad \text{Eq. 1}$$

Since the feedback voltage $V_{FB}$ is across the current-setting resistor R, the current I through the current-setting resistor R is given substantially by the following relationship:

$$I=V_{FB}/R=V_{REF}/R \quad \text{Eq. 2}$$

The current I also flows through the channel of the FET N1 and through the load resistor αR. Thus, the output voltage $V_O$ of the voltage mirroring circuit 100, taken off the drain of the FET N1, is given substantially by the following relationship:

$$V_O=V_{DD}-I\alpha R=V_{DD}-\alpha V_{REF} \quad \text{Eq. 3}$$

As equation 3 illustrates, the voltage mirroring circuit 100 has generated an output voltage $V_O$ that derives from the reference $V_{REF}$. The output voltage $V_O$ varies as a function of α, which is the ratio of the resistance of the load resistor αR to the resistance of the current-setting resistor R. The output voltage $V_O$ being a function of a resistor ratio makes it less susceptible to process errors.

With regard to sufficient headroom for the voltage mirroring circuit 100 to output the desired output voltage $V_O$, the supply voltage $V_{DD}$ needs to accommodate the voltage drop $\alpha V_{REF}$ across the load resistor αR, the voltage drop $V_{N1}$ across the FET N1, and the voltage drop $V_{REF}$ across the current-sensing resistor R. Thus, the following relationship substantially holds:

$$(1+\alpha)\ V_{REF}+V_{N1}<V_{DD} \quad \text{Eq. 4}$$

Within limits, $V_{REF}$ can be divided down to use less headroom and parameter α can be rescaled to obtain the same desired output voltage $V_O$ in accordance with the relationship stated in equation 4.

Figure 2A:
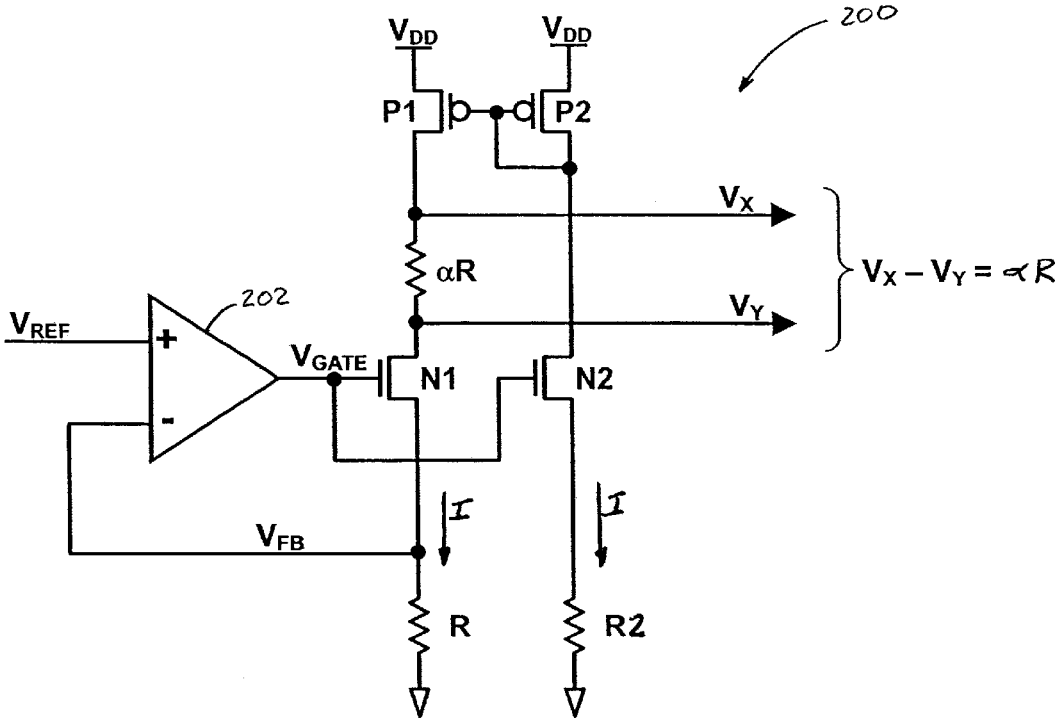
FIG. 2A illustrates a schematic diagram of another exemplary voltage mirroring circuit in accordance with an embodiment of the invention.

FIG. 2A illustrates a schematic diagram of another exemplary voltage mirroring circuit 200 in accordance with an embodiment of the invention. The voltage mirroring circuit 200 is similar to voltage mirroring circuit 100 in that it comprises an operational amplifier 202, an n-channel field effect transistor (FET) N1, a current-setting resistor R, and a load resistor αR. The operational amplifier 202 includes a positive input to receive a reference voltage $V_{REF}$, a negative input coupled to the source of the FET N1 and an end of the current-setting resistor R, and an output coupled to the gate of the FET N1. The other end of the current-setting resistor R can be connected to ground potential. The load resistor αR is connected between the power supply voltage rail $V_{DD}$ and the drain of the FET N1.

The voltage mirroring circuit 200 differs from the voltage mirroring circuit 100 in that it further comprises a first p-channel FET P1 having a source coupled to the power supply rail $V_{DD}$ and a drain coupled to an end of the load resistor $\alpha R$. The voltage mirroring circuit 200 further comprises a second p-channel FET P2 having a source coupled to the power supply rail $V_{DD}$ and a drain coupled to the gates of the first and second p-channel FETs P1–2. Additionally, the voltage mirroring circuit 200 comprises a second n-channel FET N1 having a drain coupled to the drain of the second p-channel FET P2, a source coupled to an end of a resistor R2, and a gate coupled to the gate of the first n-channel FET N1. The other end of the resistor R2 can be connected to ground potential.

The voltage mirroring circuit 200 operates similarly as voltage mirroring circuit 100 in that the operational amplifier 202 drives the first n-channel FET N1 to force the feedback voltage $V_{FB}$ to be substantially the same as the reference voltage $V_{REF}$ (see equation 1). Accordingly, the current I through the current-setting resistor R is $V_{REF}/R$ (see equation 2). This current I also flows through the load resistor $\alpha R$. Therefore, the voltage drop ($V_X$–$V_Y$) across the load resistor $\alpha R$ is given substantially by the following equation:

$$V_X - V_Y = I\alpha R = (V_{REF}/R)\ \alpha R = \alpha V_{REF} \qquad \text{Eq. 5}$$

In the case of voltage mirroring circuit 200, the addition of the first p-channel FET P1 between the load resistor $\alpha R$ and the power supply rail $V_{DD}$ makes the voltages $V_X$ and $V_Y$ on either side of the load resistor $\alpha R$ substantially float with respect to the power supply voltage $V_{DD}$. To ensure that the voltages $V_X$ and $V_Y$ float with respect to the power supply voltage $V_{DD}$, the drain current of the first p-channel FET P1 should be substantially the same as the current I through the load resistor $\alpha R$.

Therefore to maintain the drain current of FET P1 substantially the same as current 1, the voltage mirroring circuit 200 includes a current control circuit comprising the second p-channel FET P2, the second n-channel FET N2, and the second resistor R2. The first and second n-channel FETs N1–2 are substantially matched as are the resistances of resistors R and R2. Therefore, the current through the second resistor R2 is substantially the same as the current I through the current-setting resistor R (i.e. by current mirroring). The current through the second resistor R2 also flows through the second p-channel FET P2. The first and second p-channel FETs P1–2 are substantially matched. Since the gates of FETs P1–2 are connected in common, the drain current through the first p-channel FET P1 is substantially the same as the current through the second p-channel FET P2, which in turn, is substantially the same as the current I through the current-setting resistor R. Again, this ensures that the voltages $V_X$ and $V_Y$ substantially float with respect to the power supply voltage $V_{DD}$.

Figure 2B:
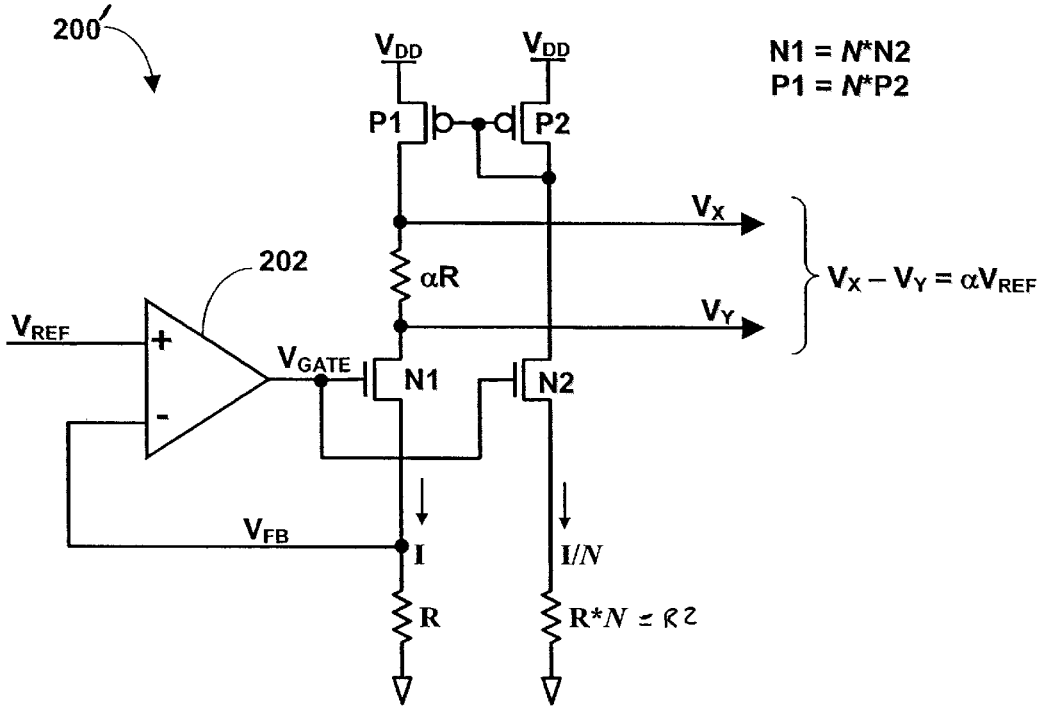
FIG. 2B illustrates a schematic diagram of another exemplary voltage mirroring circuit in accordance with an embodiment of the invention.

FIG. 2B illustrates a schematic diagram of an exemplary voltage mirroring circuit 200' in accordance with an embodiment of the invention. The voltage mirroring circuit 200' is similar to voltage mirroring circuit 200 except that the current control circuit is designed to operate with a current I/N a factor of N lower than the current I through the current setting resistor R. This allows the voltage mirroring circuit 200' to operate more power efficiently. In this regard, the second n-channel FET N2 is sized to operate with a current density a factor of N below the current density of the first n-channel FET N1. In order the gate-to-source voltage of the n-channel FETs N1–2 to be substantially the same, the resistor R2 is N times greater than the current setting resistor R, (i.e. R*N). Therefore, the current through resistor R2 is approximately I/N, which also flows through the second p-channel FET P2. The second p-channel FET P2 is also sized to operate with a current density a factor of N below the current density of the first p-channel FET P1. Thus, a current of I/N through the second p-channel FET P2 results substantially in a current I through the first p-channel FET P1.

With regard to sufficient headroom for the voltage mirroring circuits 200 and 200' to output the desired output voltage $V_X$–$V_Y$, a the supply voltage $V_{DD}$ needs to accommodate the voltage drop $V_{P1}$ across the FET P1, the voltage drop $\alpha V_{REF}$ across the load resistor $\alpha R$, the voltage drop $V_{N1}$ across the FET N1, and the voltage drop $V_{REF}$ across the current-sensing resistor R. Thus, the following relationship substantially holds:

$$(1\alpha)\ V_{REF} + V_{N1} + V_{P1} < V_{DD} \qquad \text{Eq. 6}$$

Within limits, $V_{REF}$ can be divided down to use less headroom and parameter $\alpha$ can be rescaled to obtain the same desired output voltage $V_X$–$V_Y$ in accordance with the relationship stated in equation 6.

Figure 3:
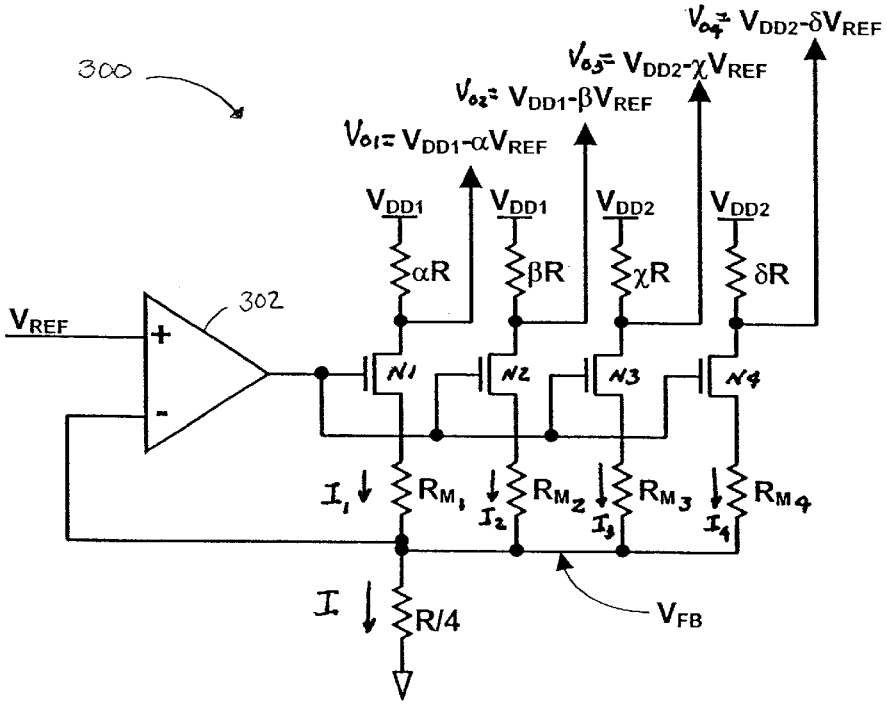
FIG. 3 illustrates a schematic diagram of an exemplary multiple-output voltage mirroring circuit in accordance with an embodiment of the invention.

FIG. 3 illustrates a schematic diagram of an exemplary multiple-output voltage mirroring circuit 300 in accordance with an embodiment of the invention. The multiple-output voltage mirroring circuit 300 generates a plurality of output voltages derived from a common reference voltage $V_{REF}$. The voltage mirroring circuit 300 comprises an operational amplifier 302, a plurality of n-channel field effect transistors (FETs) N1–4, a plurality of source-biasing transistors $R_{M1\text{-}4}$, a current-setting resistor R/4, and a plurality of load resistors $\alpha R$, $\beta R$, $\chi R$, and $\delta R$. The operational amplifier 302 includes a positive input to receive a reference voltage $V_{REF}$, a negative input coupled to an end of the current-setting resistor R/4, and an output coupled to the respective gates of FETs N1–4. The other end of the current-setting resistor R can be connected to ground potential. The source-biasing resistors $R_{M1\text{-}4}$ are coupled between the current-setting resistor R and the respective sources of the FETs N1–4. The load resistors $\alpha R$ and $\beta R$ are connected between a first power supply voltage rail $V_{DD1}$ and the respective drains of FETs N1–2, and load resistors $\chi R$, and $\delta R$ are coupled between a second power supply voltage rail $V_{DD2}$ and the respective drains of FETs N3–4. It shall be noted that the source-biasing resistors $R_{M1\text{-}4}$ are optional. They are used to better ensure that the currents are equal through the respective FETs N1–4. If the matching of FETs N1–4 is sufficient for an application, the source-biasing resistors $R_{M1\text{-}4}$ are not needed.

In operation, the operational amplifier 302 drives the plurality of FETs N1–4 to force the feedback voltage $V_{FB}$ to be substantially equal to the reference voltage $V_{REF}$ (see equation 1). The current I through the current-setting resistor R/4 is substantially given by the following relationship:

$$I = 4 * V_{REF}/R \qquad \text{Eq. 7}$$

In this exemplary embodiment, the FETs N1–4 are substantially matched and the source-biasing resistors $R_{M1-4}$ are substantially matched. Therefore, the drain currents $I_{1-4}$ of the FETs N1–4 are substantially the same and given substantially by the following relationship:

$$I_1 = I_2 = I_3 = I_4 = I/4 = V_{REF}/R \qquad \text{Eq. 8}$$

The drain currents $I_{1\text{-}4}$ of FETs N1–4 flow respectively through load resistors $\alpha R$, $\beta R$, $\chi R$, and $\delta R$. Therefore, the output voltages $V_{O1\text{-}4}$ of the multiple-output voltage mirroring circuit 300 are given substantially by the following equations:

$$V_{O1}=V_{DD1}-I_1*\alpha R=V_{DD1}-V_{REF}/R*\alpha R=V_{DD1}-\alpha V_{REF} \quad \text{Eq. 9a}$$

$$V_{O2}=V_{DD1}-I_2*\beta R=V_{DD1}-V_{REF}/R*\beta R=V_{DD1}-\beta V_{REF} \quad \text{Eq. 9b}$$

$$V_{O3}=V_{DD2}-I_3*\chi R=V_{DD2}-V_{REF}/R*\chi R=V_{DD2}-\chi V_{REF} \quad \text{Eq. 9c}$$

$$V_{O4}=V_{DD2}-I_4*\delta R=V_{DD2}-V_{REF}/R*\delta R=V_{DD2}-\delta V_{REF} \quad \text{Eq. 9d}$$

With regard to sufficient headroom for the voltage mirroring circuit 300 to output the desired output voltages $V_{O1-4}$, the supply voltages $V_{DD1-2}$ need to accommodate the respective voltage drops $\alpha V_{REF}$, $\beta V_{REF}$, $\chi V_{REF}$, and $\delta V_{REF}$ across the respective load resistors $\alpha R$, $\beta R$, $\chi R$, and $\delta R$, the voltage drops $V_{N1-4}$ across the respective FETs N1–4, the voltage drops $V_{M1-4}$ across the respective source-biasing resistors $R_{M1-4}$, and the voltage drop $V_{REF}$ across the current-sensing resistor R/4. Thus, the following relationships substantially hold:

$$(1+\alpha)V_{REF}+V_{N1}+V_{M1}<V_{DD1} \quad \text{Eq. 10a}$$

$$(1+\beta)V_{REF}+V_{N2}+V_{M2}<V_{DD1} \quad \text{Eq. 10b}$$

$$(1+\chi)V_{REF}+V_{N3}+V_{M3}<V_{DD2} \quad \text{Eq. 10c}$$

$$(1+\delta)V_{REF}+V_{N4}+V_{M4}<V_{DD2} \quad \text{Eq. 10d}$$

Within limits, $V_{REF}$ can be divided down to use less headroom and parameters $\alpha$, $\beta$, $\chi$, and $\delta$ can be rescaled to obtain the same desired output voltages $V_{O1-4}$ in accordance with the relationships stated in equations 10a–d.

Figure 4:
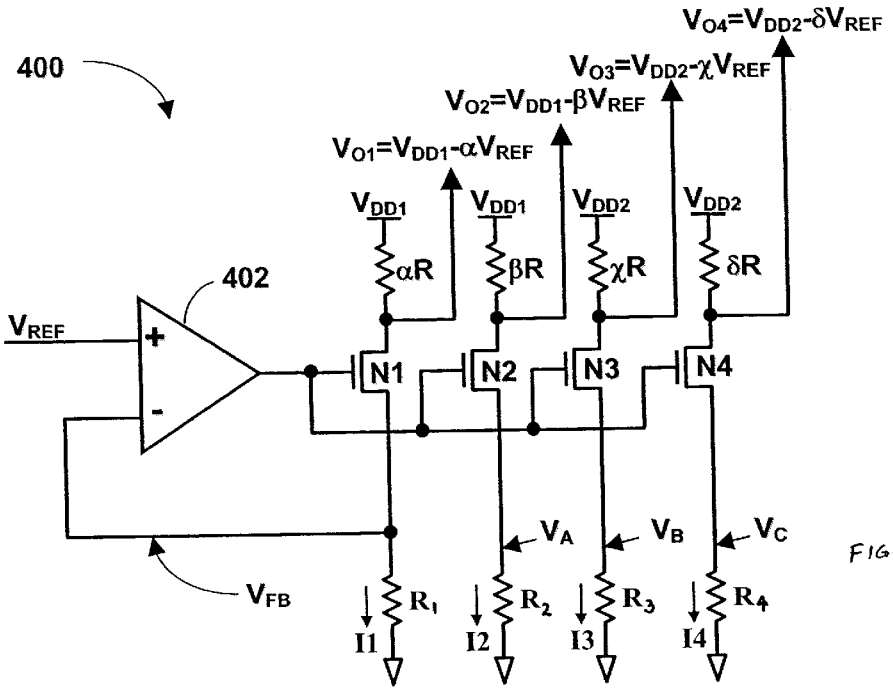
FIG. 4 illustrates a schematic diagram of another exemplary multiple-output voltage mirroring circuit in accordance with an embodiment of the invention.

FIG. 4 illustrates a schematic diagram of another exemplary multiple-output voltage mirroring circuit 400 in accordance with an embodiment of the invention. The multiple-output voltage mirroring circuit 400 generates a plurality of output voltages derived from a common reference voltage $V_{REF}$. The voltage mirroring circuit 400 comprises an operational amplifier 402, a plurality of n-channel field effect transistors (FETs) N1–4, a plurality of current-equalizing resistors R2–4 including current-setting resistor R1, and a plurality of load resistors $\alpha R$, $\beta R$, $\chi R$, and $\delta R$. The operational amplifier 402 includes a positive input to receive a reference voltage $V_{REF}$, a negative input coupled to an end of the current-setting resistor $R_1$, and an output coupled to the respective gates of FETs N1–4. The current-setting resistor R1 and the current-equalizing resistors R2–4 are coupled respectively between the sources of the FETs N1–4 and ground potential. The load resistors $\alpha R$ and $\beta R$ are coupled between a first power supply voltage rail $V_{DD1}$ and the respective drains of FETs N1–2, and load resistors $\chi R$, and $\delta R$ are coupled between a second power supply voltage rail $V_{DD2}$ and the respective drains of FETs N3–4.

In operation, the operational amplifier 402 drives FET N1 to force the feedback voltage $V_{FB}$ to be substantially equal to the reference voltage $V_{REF}$ (see equation 1). The current $I_1$ through the current-setting resistor $R_1$ is substantially given by the following relationship:

$$I_1=V_{REF}/R \quad \text{Eq. 11}$$

In this exemplary embodiment, the FETs N1–4 are substantially matched and the current-setting resistor R1 is substantially matched to the current-equalizing resistor R2–4. This makes the gate-to-source voltages of the FETs N1–4 to be substantially the same (i.e. current mirroring), thereby making the drain currents $I_{1-4}$ of the FETs N1–4 given substantially by the following relationship:

$$I_1=I_2=I_3=I_4=V_{REE}/R \quad \text{Eq. 12}$$

The drain currents $I_{1-4}$ of FETs N1–4 flow respectively through load resistors $\alpha R$, $\beta R$, $\chi R$, and $\delta R$. Therefore, the output voltages $V_{O1-4}$ of the multiple-output voltage mirroring circuit 400 are given substantially by the following equations:

$$V_{O1}=V_{DD1}-I_1*\alpha R=V_{DD1}-V_{REF}/R*\alpha R=V_{DD1}-\alpha V_{REF} \quad \text{Eq. 13a}$$

$$V_{O2}=V_{DD1}=I_2*\beta R=V_{DD1}-V_{REF}/R*\beta R=V_{DD1}-\beta V_{REF} \quad \text{Eq. 13b}$$

$$V_{O3}=V_{DD2}-I_3*\chi R=V_{DD2}-V_{REF}/R*\chi R=V_{DD2-\chi VREF} \quad \text{Eq. 13c}$$

$$V_{O4}=V_{DD2}-I_4*\delta R=V_{DD2}-V_{REF}/R*\delta R=V_{DD2}-\delta V_{REF} \quad \text{Eq. 13d}$$

With regard to sufficient headroom for the voltage mirroring circuit 400 to output the desired output voltages $V_{O1-4}$, the supply voltages $V_{DD1-2}$ need to accommodate the respective voltage drops $\alpha V_{REF}$, $\beta V_{REF}$, $\chi V_{REF}$, and $\delta V_{REF}$ across the respective load resistors $\alpha R$, $\beta R$, $\chi R$, and $\delta R$, the voltage drops $V_{N1-4}$ across the respective FETs N1–4, and the voltage drops $V_{REF}$ across the respective resistors $R_{1-4}$. Thus, the following relationships substantially hold:

$$(1+\alpha)V_{REF}+V_{N1}<V_{DD1} \quad \text{Eq. 14a}$$

$$(1+\beta)V_{REF}+V_{N2}<V_{DD1} \quad \text{Eq. 14b}$$

$$(1+\chi)V_{REF}+V_{N3}<V_{DD2} \quad \text{Eq. 14c}$$

$$(1+\delta)V_{REF}+V_{N4}<V_{DD2} \quad \text{Eq. 14d}$$

Within limits, $V_{REF}$ can be divided down to use less headroom and parameters $\alpha$, $\beta$, $\chi$, and $\delta$ can be rescaled to obtain the same desired output voltages $V_{O1-4}$ in accordance with the relationships stated in equations 14a–d.

Figure 5:
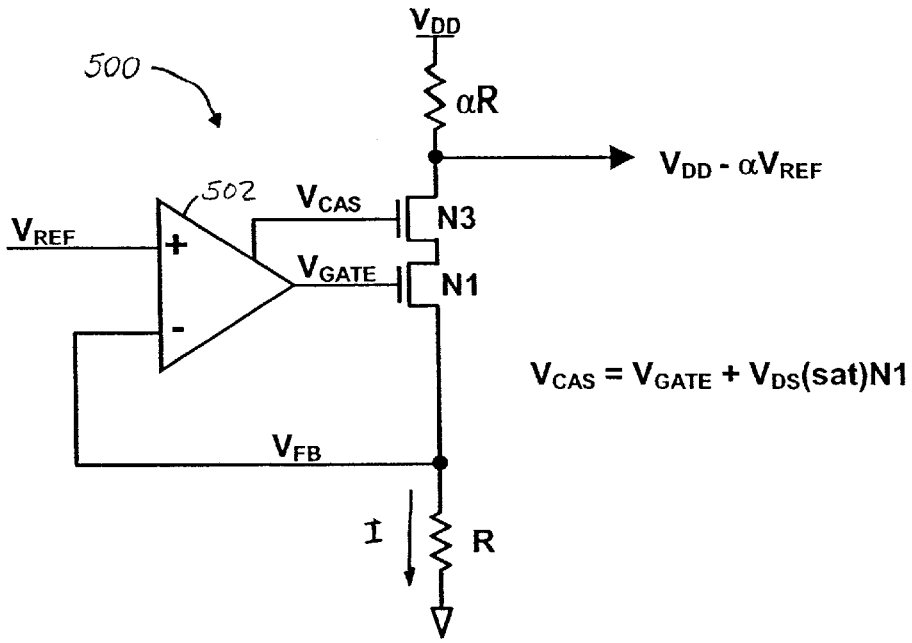
FIG. 5 illustrates a schematic diagram of an exemplary voltage mirroring circuit with cascoding control in accordance with an embodiment of the invention.

FIG. 5 illustrates a schematic diagram of an exemplary voltage mirroring circuit 500 with cascading control in accordance with an embodiment of the invention. The voltage mirroring circuit 500 operates similarly as to voltage mirroring circuit 100 in that it generates an output voltage $V_O$ that is derived from a reference voltage $V_{REF}$. The voltage mirroring circuit 500 comprises an operational amplifier 502, a first n-channel field effect transistor (FET) N1, a second n-channel field effect transistor (FET) N2, a current-setting resistor R, and a load resistive resistor $\alpha R$. The operational amplifier 502 includes a positive input to receive a reference voltage $V_{REF}$, a negative input coupled to the source of the FET N1, an output coupled to the gate of the FET N1, and a cascode biasing output $V_{CAS}$ coupled to the gate of the second FET N3. The current-setting resistor R is coupled between the source of the FET N1 and to a ground potential. The source of the second FET N3 is coupled to the drain of the first FET N1. The load resistor $\alpha R$ is coupled between the power supply voltage rail $V_{DD}$ and the drain of the FET N3.

In operation, the operational amplifier 502 sets the gate voltage $V_{GATE}$ of the FET N1 such that the feedback voltage $V_{FB}$ applied to the negative input of the operational amplifier 502 is substantially equal to the reference voltage $V_{REF}$ applied to the positive input of the operational amplifier 502 (See equation 1). Since the feedback voltage $V_{FB}$ is across the current-setting resistor R, the current I through the current-setting resistor R is approximately $V_{REF}/R$ (See equation 2). The current I also flows through the FETs N1 and N3 as well as through the load resistor $\alpha R$. Thus, the output voltage $V_O$ of the voltage mirroring circuit 500, taken off the drain of the FET N3, is substantially $V_{DD}-\alpha V_{REF}$ (See equation 3).

In this embodiment, the cascoding FET N3 is provided to ensure that the drain-to-source voltage ($V_{DS}$) of FET N1 is maintained substantially constant. This substantially increases the output impedance of the voltage mirroring circuit 500, thereby making the circuit 500 substantially more stable with variation in the output load of the circuit 500. In order to properly maintain $V_{DS}$ of FET N1 substantially constant, the cascode voltage $V_{CAS}$ applied to the gate of FET N3 (assuming N3 is substantially equal in size to N1) is given by the following relationship:

$$V_{CAS} \geqq V_{GATE} + V_{DS}(sat)N1 \quad \text{Eq. 15}$$

where $V_{GATE}$ is the voltage applied to the gate of FET N1 and $V_{DS}$(sat)N1 is the saturation voltage of FET N1 at current I. The cascode voltage $V_{CAS}$ should not be too large or the headroom of the voltage mirror will be affected. The cascode voltage $V_{CAS}$ may be generated by the operational amplifier 502 as shown or by some other device or circuit.

With regard to sufficient headroom for the voltage mirroring circuit 500 to output the desired output voltage $V_O$, the supply voltage $V_{DD}$ needs to accommodate the voltage drop $\alpha V_{REF}$ across the load resistor $\alpha$R, the voltage drop $V_{N3}$ across the FET N3, the voltage drop $V_{N1}$ across the FET N1, and the voltage drop $V_{REF}$ across the current-sensing resistor R. Thus, the following relationships substantially hold:

$$(1+\alpha)V_{REF} + V_{N1} + V_{N3} < V_{DD} \quad \text{Eq. 16a}$$

or $$\alpha V_{REF} + V_{CAS} + V_{N3}(sat) < V_{DD} \quad \text{Eq. 16b}$$

Within limits, $V_{REF}$ can be divided down to use less headroom and parameter $\alpha$ can be rescaled to obtain the same desired output voltage $V_O$ in accordance with the relationships stated in equations 16a–b.

Figure 6:
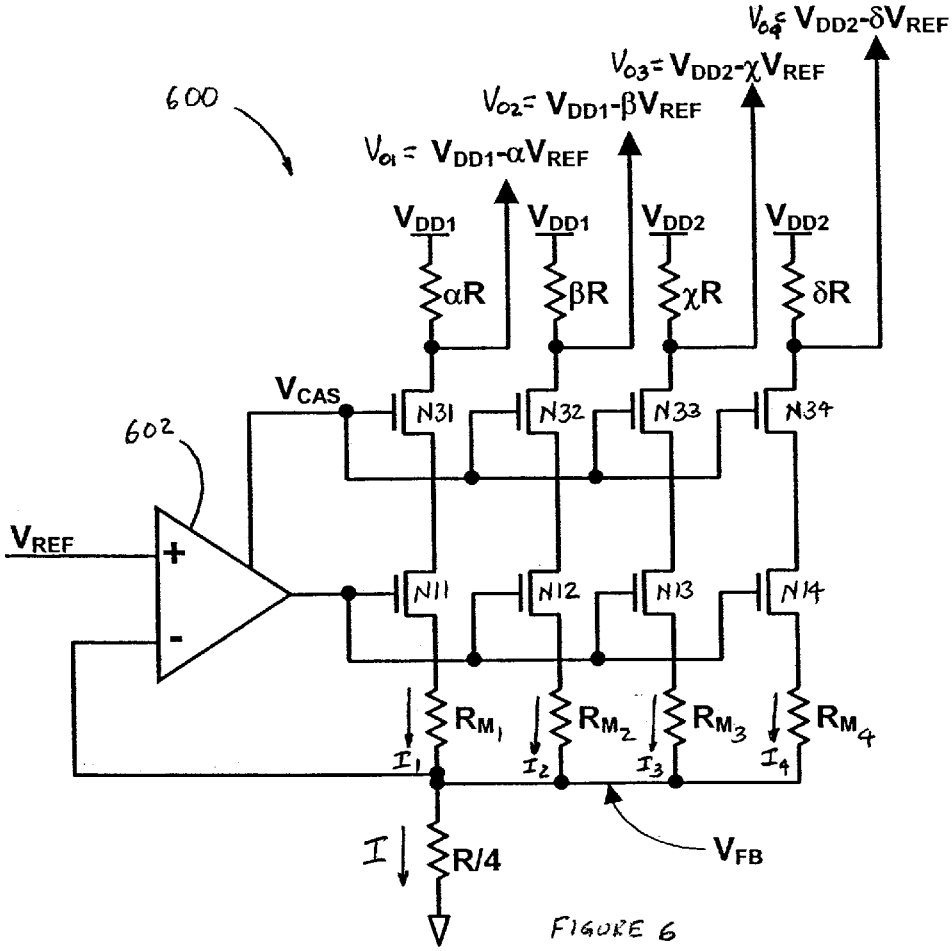
FIG. 6 illustrates a schematic diagram of an exemplary multiple-output voltage mirroring circuit with cascoding control in accordance with an embodiment of the invention.

FIG. 6 illustrates a schematic diagram of an exemplary multiple output voltage mirroring circuit 600 with cascoding control in accordance with an embodiment of the invention. The multiple-output voltage mirroring circuit 600 operates similarly to voltage mirroring circuit 300 in that it generates a plurality of output voltages derived from a common reference voltage $V_{REF}$. The voltage mirroring circuit 600 comprises an operational amplifier 602, a plurality of n-channel field effect transistors (FETs) N11–14, a plurality of cascoding FETs N31–34, a plurality of source-biasing transistors $R_{M1\text{-}4}$, a current-setting resistor R/4, and a plurality of load resistors $\alpha$R, $\beta$R, $\chi$R, and $\delta$R.

The operational amplifier 602 includes a positive input to receive a reference voltage $V_{REF}$, a negative input coupled to an end of the current-setting resistor R/4, an output coupled to the respective gates of FETs N11–14, and a cascode biasing output $V_{CAS}$ coupled to the gates of the cascoding FETs N31–34. The other end of the current-setting resistor R/4 may be coupled to ground potential. The source-biasing resistors $R_{M1\text{-}4}$ are coupled between the current-setting resistor R/4 and the respective sources of the FETs N11–14. The sources of the cascading FETs N31–34 are coupled to the respective drains of the FETs N11–N14. The load resistors $\alpha$R and $\beta$R are coupled between a first power supply voltage rail $V_{DD1}$ and the respective drains of FETs N31–32, and load resistors $\chi$R, and $\delta$R are coupled between a second power supply voltage rail $V_{DD2}$ and the respective drains of FETs N33–34.

In operation, the operational amplifier 602 drives the plurality of FETs N11–14 to force the feedback voltage $V_{FB}$ to be substantially equal to the reference voltage $V_{REF}$ (see equation 1). The current I through the current-setting resistor R/4 is $4*V_{REF}/R$ (see equation 7). In this exemplary embodiment, the FETs N11–14 are substantially matched and the source-biasing resistors $R_{M1\text{-}4}$ are substantially matched. Therefore, the drain currents $I_{1\text{-}4}$ of the FETs N11–14 are substantially equal to $V_{REF}/R$ (see equation 8). The drain currents $I_{1\text{-}4}$ of FETs N11–14 flow respectively through load resistors $\alpha$R, $\beta$R, $\chi$R, and $\delta$R. Therefore, the output voltages $V_{O1\text{-}4}$ of the multiple-output voltage mirroring circuit 600 are given substantially by equations 9a–d.

In this embodiment, the cascading FETs N31–34 are provided to ensure that the respective drain-to-source voltage ($V_{DS1\text{-}4}$) of FET N11–14 are maintained substantially constant. This substantially increases the respective output impedances of the voltage mirroring circuit 600, thereby making the circuit 600 substantially more stable with variation in the output loads of the circuit 600. In order to properly maintain the respective $V_{DS1\text{-}4}$ of FET N11–14 substantially constant, the cascode voltage $V_{CAS}$ applied to the gates of FET N31–34 should be as stated in equation 16a or 16b.

With regard to sufficient headroom for the voltage mirroring circuit 600 to output the desired output voltages $V_{O1\text{-}4}$, the supply voltages $V_{DD1\text{-}2}$ need to accommodate the respective voltage drops $\alpha V_{REF}$, $\beta V_{REF}$, $\chi V_{REF}$, and $\delta V_{REF}$ across the respective load resistors $\alpha$R, $\beta$R, $\chi$R, and $\delta$R, the voltage drops $V_{N31\text{-}34}$ across the respective FETs N31–34, the voltage drops $V_{N11\text{-}14}$ across the respective FETs N11–14, the voltage drops $V_{M1\text{-}4}$ across the respective source-biasing resistors $R_{M1\text{-}4}$, and the voltage drop $V_{REF}$ across the current-sensing resistor R/4. Thus, the following relationships substantially hold:

$$(1+\alpha)V_{REF} + V_{N31} + V_{N11} + V_{M1} < V_{DD1} \quad \text{Eq. 17a}$$

$$(1+\beta)V_{REF} + V_{N32} + V_{N12} + V_{M2} < V_{DD1} \quad \text{Eq. 17b}$$

$$(1+\chi)V_{REF} + V_{N33} + V_{N13} + V_{M3} < V_{DD2} \quad \text{Eq. 17c}$$

$$(1+\delta)V_{REF} + V_{N34} + V_{N14} + V_{M4} < V_{DD2} \quad \text{Eq. 17d}$$

or $$\alpha V_{REF} + V_{CAS} + V_{N31}(sat) < V_{DD} \quad \text{Eq. 17e}$$

$$\beta V_{REF} + V_{CAS} + V_{N32}(sat) < V_{DD} \quad \text{Eq. 17f}$$

$$\chi V_{REF} + V_{CAS} + V_{N33}(sat) < V_{DD} \quad \text{Eq. 17g}$$

$$\delta V_{REF} + V_{CAS} + V_{N34}(sat) < V_{DD} \quad \text{Eq. 17h}$$

Within limits, $V_{REF}$ can be divided down to use less headroom and parameters $\alpha$, $\beta$, $\chi$, and $\delta$ can be rescaled to obtain the same desired output voltages $V_{O1\text{-}4}$ in accordance with the relationships stated in equations 17a–h.

In the above exemplary embodiments, the reference voltage $V_{REF}$ and the current-setting resistor were referenced from the same voltage potential. That is, one end of the current-setting resistor was connected to ground potential and the reference voltage $V_{REF}$ is that much above ground potential. This need not be the case, as is explained by the following exemplary embodiment.

Figure 7:
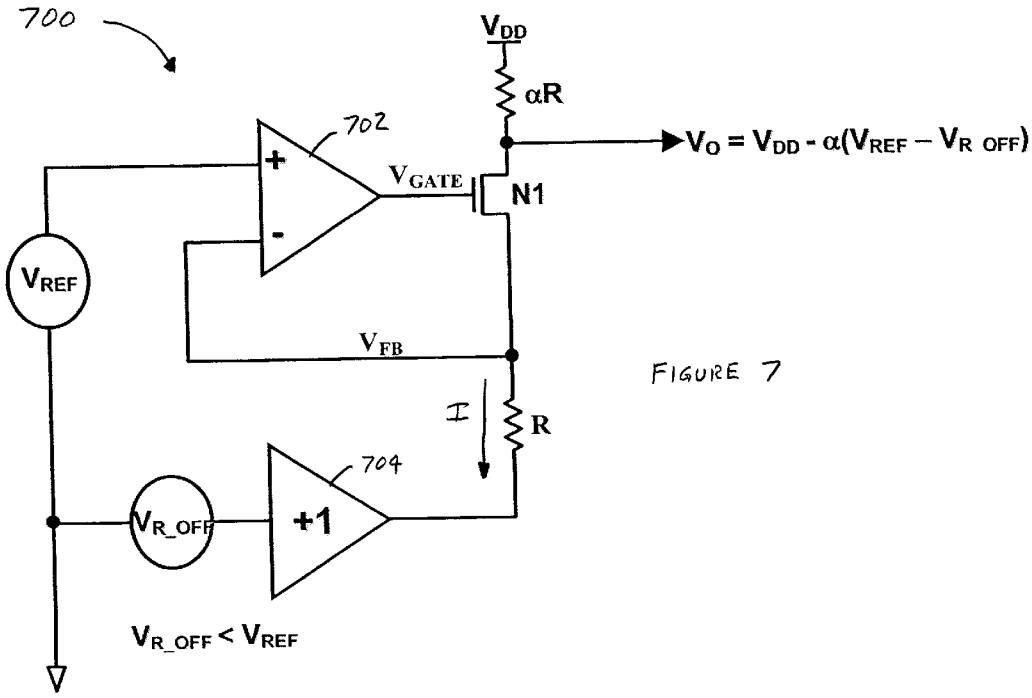
FIG. 7 illustrates a schematic diagram of another exemplary voltage mirroring circuit in accordance with an embodiment of the invention.

FIG. 7 illustrates a schematic diagram of another exemplary voltage mirroring circuit 700 in accordance with an embodiment of the invention. The voltage mirroring circuit 700 comprises an operational amplifier 702, a unity-gain amplifier 704, an n-channel FET N1, a current-setting resistor R, a load resistor $\alpha$R, a reference voltage source $V_{REF}$, and an offset voltage source $V_{R_OFF}$. The operational amplifier 702 includes a positive input coupled to the reference voltage source $V_{REF}$, a negative input coupled to the source of the FET N1 and an end of the current-setting resistor R, and an output coupled to the gate of the FET N1. The other end of the current-setting resistor R is coupled to the output of the unity gain amplifier 704, which in turn, has an input coupled to the offset voltage source $V_{R_OFF}$. Both the reference voltage source $V_{REF}$ and the offset voltage source $V_{R_OFF}$ are referenced from ground potential.

In operation, the operational amplifier 702 sets the gate voltage $V_{GATE}$ of the FET N1 such the feedback voltage $V_{FB}$ applied to the negative input of the operational amplifier 702 is substantially equal to the reference voltage $V_{REF}$ applied to the positive input of the operational amplifier 702 (see equation 1). Accordingly, the current I through the current-setting resistor R is equal to the voltage drop ($V_{REF}-V_{R_OFF}$) over the resistance R. Thus, the following relationship substantially holds:

$$I=(V_{REF}-V_{R_OFF})/R \quad \text{Eq. 18}$$

The current I also flows through the channel of the FET N1 and through the load resistor αR. Thus, the output voltage $V_O$ of the voltage mirroring circuit 700, taken off the drain of the FET N1, is given substantially by the following relationship:

$$V_O=V_{DD}-((V_{REF}-V_{R_OFF})/R*\alpha R)=V_{DD}-\alpha(V_{REF}-V_{R_OFF}) \quad \text{Eq. 19}$$

As equation 19 illustrates, the voltage mirroring circuit 700 generates an output voltage VO that derives from a difference between reference voltage $V_{REF}$ and an offset voltage $V_{R_OFF}$. Thus, the voltage mirroring circuit 700 can be used as a comparator or a differential amplifier. The voltage $V_{R_OFF}$ can also be made time-variable. In this case, the output voltage $V_O$ would be modulated $V_{R_OFF}(t)$ and ratioed α.

Although the exemplary embodiments described above used field effect transistors (FETs), it shall be understood that they can be implemented in bipolar technology. Also the channel doping types of the FETs can be interchanged (i.e. an n-channel transistor can be interchanged with a p-channel transistor, and vice-versa). The resistors can be interchanged with any type of resistive elements.

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than a restrictive sense.

It is claimed:

1. An apparatus, comprising:

an operational amplifier including first and second inputs and an output, said first input to receive an input voltage;

a transistor including a conduction channel situated between first and second terminals and a control terminal to control the conductivity of the conduction channel, said second terminal of said transistor being connected to said second input of said operational amplifier, said control terminal of said transistor being connected to said output of said operational amplifier, and said first terminal of said transistor to produce an output voltage that derives from said input voltage;

a first resistor connected between a first voltage terminal and said first terminal of said transistor; and a second resistor connected between said second terminal of said transistor and a second voltage terminal.

2. The apparatus of claim 1, wherein said first input includes a positive input of said operational amplifier and said second input includes a negative input of said operational amplifier.

3. The apparatus of claim 1, wherein said transistor comprises a field effect transistor (FET) with said first terminal being a drain of said FET, said second terminal being a source of said FET, and said control terminal being a gate of said FET.

4. The apparatus of claim 1, wherein said transistor comprises a bipolar transistor with said first terminal being a collector of said bipolar transistor, said second terminal being an emitter of said bipolar transistor, and said control terminal being a base of said bipolar transistor.

5. The apparatus of claim 1, further comprising a second transistor including a second conduction channel situated between third and fourth terminals and a second control terminal to control the conductivity of said second conduction channel, wherein said second conduction channel is situated between said first voltage terminal and said first resistor.

6. The apparatus of claim 5, further comprising a current control circuit coupled to the control terminal of said second transistor to control the current through said second conduction channel of said second transistor.

7. The apparatus of claim 6, wherein said current control circuit causes the current through said second channel of said second transistor to be substantially equal to the current through said conduction channel of said transistor.

8. The apparatus of claim 1, wherein said output voltage is a function of a ratio of the resistance of said first resistor to the resistance of said second resistor.

9. The apparatus of claim 1, wherein said second voltage terminal is capable of producing a voltage above or below ground potential.

10. The apparatus of claim 1, wherein said second voltage terminal is capable of producing a time-variable voltage.

11. The apparatus of claim 6, wherein said current control circuit comprises:

a third transistor including a third conduction channel situated between fifth and sixth terminals and a third control terminal, wherein said fifth terminal is coupled to said first voltage terminal and said control terminal is coupled to said sixth terminal of said third transistor and to said second control terminal of said second transistor;

a fourth transistor including a fourth conduction channel situated between seventh and eighth terminals and a fourth control terminal, wherein said seventh terminal of said fourth transistor is coupled to said sixth terminal of said third transistor, and said fourth control terminal is coupled to said output of said operational amplifier; and a third resistive element coupled between said eighth terminal of said fourth transistor and said second voltage terminal.

12. The apparatus of claim 1, a voltage control circuit to control a voltage drop across said conduction channel of said transistor.

13. The apparatus of claim 12, wherein said voltage control circuit comprises a second transistor having a second conduction channel situated between said first resistor and said conduction channel of said first transistor.

14. A method, comprising:

mirroring an input voltage onto an intermediate voltage;

forming a current by applying said intermediate voltage across a first resistor;

directing said current through a second resistor to form an output voltage; and controlling said current such that said current is substantially constant.

15. The method of claim 14, further comprising making said output voltage substantially float with respect to a supply voltage.

16. The method of claim 14, wherein said output voltage is a function of a ratio of the resistance of said second resistive element to the resistance of said first resistive element.

17. The method of claim 14, further comprising controlling said current such that said current remains substantially constant.

18. An apparatus, comprising:

an operational amplifier including first and second inputs and an output;

a plurality of transistors including respective conduction channels and respective control terminals to control the conductivity of said respective conduction channels, said respective control terminals of said respective transistor being connected to said output of said operational amplifier;

a plurality of load resistors connected between respective voltage terminals and respective conduction channels of said transistors; and a current-setting resistive element to set the currents through respective conduction channels of said transistors, said second input of said operational amplifier coupled between at least one of said conduction channel and said current-setting resistive element.

19. The apparatus of claim 18, further comprising a set of resistive elements coupled between respective conduction channels of said transistors and said current-setting respective element.

20. The apparatus of claim 18, further comprising a first set of resistive elements including said current-setting resistor coupled in series with respective conduction channels of said transistors.

21. The apparatus of claim 18, wherein said first input includes a positive input of said operational amplifier and said second input includes a negative input of said operational amplifier.

22. The apparatus of claim 18, a voltage control circuit to control voltage drops across respective conduction channels of said transistors.

23. The apparatus of claim 22, wherein said voltage control circuit comprises a second set of transistors having respective conduction channels situated between respective load resistive elements and respective conduction channels of said first transistors.

24. A method, comprising:

mirroring an input voltage onto an intermediate voltage;

forming a first current by applying said intermediate voltage across a first resistive element;

mirroring said first current to form a plurality of currents; and directing said currents including said first current through respective resistors to form respective output voltages.

25. The method of claim 24, further comprising controlling said currents such that said currents remain substantially constant.

26. The method of claim 25, wherein said plurality of currents including said first current are substantially equal to each other.

* * * * *

UNITED STATES PATENT AND TRADEMARK OFFICE

CERTIFICATE OF CORRECTION

PATENT NO. : 6,570,371 B1
DATED : May 27, 2003
INVENTOR(S) : Volk

It is certified that error appears in the above-identified patent and that said Letters Patent is hereby corrected as shown below:

Column 3,
Line 35, after “current”, delete “1”, insert -- I --.

Column 4,
Line 9, before “the supply”, delete “a”.
Line 16, delete “(1α)”, insert -- (1+ α) --.

Column 6,
Line 32, delete “cascading”, insert -- cascoding --.

Column 7,
Line 54, delete “cascading”, insert -- cascoding --.

Column 8,
Line 7, delete “cascading”, insert -- cascoding --.

Signed and Sealed this

Twenty-third Day of September, 2003

JAMES E. ROGAN
*Director of the United States Patent and Trademark Office*